US007597768B2

(12) United States Patent
Suda et al.

(10) Patent No.: US 7,597,768 B2
(45) Date of Patent: Oct. 6, 2009

(54) STEEL WIRE FOR HARD DRAWN SPRING EXCELLENT IN FATIGUE STRENGTH AND RESISTANCE TO SETTLING, AND HARD DRAWN SPRING AND METHOD OF MAKING THEREOF

(75) Inventors: Sumie Suda, Kobe (JP); Nobuhiko Ibaraki, Kobe (JP); Nao Yoshihara, Kobe (JP); Shigetsugu Yoshida, Kyoto (JP); Koji Harada, Kyoto (JP)

(73) Assignees: Kabushiki Kaisha Kobe Seiko Sho, Kobe-shi (JP); Suncall Corporation, Kyoto-shi (JP)

( * ) Notice: Subject to any disclaimer, the term of this patent is extended or adjusted under 35 U.S.C. 154(b) by 178 days.

(21) Appl. No.: 10/508,945

(22) PCT Filed: Mar. 26, 2003

(86) PCT No.: PCT/JP03/03700

§ 371 (c)(1),
(2), (4) Date: Oct. 1, 2004

(87) PCT Pub. No.: WO03/083151

PCT Pub. Date: Oct. 9, 2003

(65) Prior Publication Data

US 2005/0173028 A1 Aug. 11, 2005

(30) Foreign Application Priority Data

Apr. 2, 2002 (JP) ..... 2002-100359
Apr. 2, 2002 (JP) ..... 2002-100361

(51) Int. Cl.
*C22C 38/22* (2006.01)
*C22C 38/40* (2006.01)
*C22C 38/18* (2006.01)
*C21D 8/06* (2006.01)
*C21D 9/52* (2006.01)

(52) U.S. Cl. ..... 148/334; 148/333; 148/335; 148/580; 148/595; 148/598

(58) Field of Classification Search ..... 148/320, 148/333–335, 908, 598–599, 909, 580, 595
See application file for complete search history.

(56) References Cited

U.S. PATENT DOCUMENTS 5,455,869 A * 10/1995 Miscavige ..... 381/364

(Continued)

FOREIGN PATENT DOCUMENTS

EP 0 462 779 A2 12/1991

(Continued)

OTHER PUBLICATIONS

Database Inspec 'Online!. AN-6739795, XP-002318429, Sep. 30, 2000.

(Continued)

*Primary Examiner*—Deborah Yee
(74) *Attorney, Agent, or Firm*—Oblon, Spivak, McClelland, Maier & Neustadt, L.L.P.

(57) ABSTRACT

Disclosed is a hard-drawn spring which exhibits fatigue strength and sag resistance equal or superior to springs produced using an oil-tempered wire. The hard-drawn spring is produced using a steel wire containing 0.5 to 0.7 mass % of C, 1.0 to 1.95 mass % of Si, 0.5 to 1.5 mass % of Mn and 0.5 to 1.5 mass % of Cr, with the balance being Fe and inevitable impurities. In the steel wire, the number of carbides having circle-equivalent diameters of 0.1 μm or more is 5 particles/100 $\mu m^2$ or less.

18 Claims, 2 Drawing Sheets

U.S. PATENT DOCUMENTS

| | | | | | |
|---|---|---|---|---|---|
| 5,846,344 | A | * | 12/1998 | Kawaguchi et al. | 148/333 |
| 5,904,787 | A | | 5/1999 | Matsumoto et al. | |
| 6,224,686 | B1 | * | 5/2001 | Aoki et al. | 148/230 |
| 6,322,641 | B1 | * | 11/2001 | Makii et al. | 148/330 |
| 6,372,056 | B1 | * | 4/2002 | Kuroda et al. | 148/320 |
| 6,645,319 | B2 | * | 11/2003 | Nagao et al. | 148/330 |
| 7,074,282 | B2 | * | 7/2006 | Ibaraki et al. | 148/333 |

FOREIGN PATENT DOCUMENTS

| | | | |
|---|---|---|---|
| EP | 614994 | | 9/1994 |
| JP | 405320827 | * | 12/1993 |
| JP | 6-240408 | | 8/1994 |
| JP | 7-90495 | * | 4/1995 |
| JP | 7-136933 | | 5/1995 |
| JP | 7-188852 | | 7/1995 |
| JP | 08-120407 | * | 5/1996 |
| JP | 8-120407 | | 5/1996 |
| JP | 9-71843 | | 3/1997 |
| JP | 11-6033 | | 1/1999 |
| JP | 11-246941 | | 9/1999 |
| JP | 2002180198 | * | 6/2002 |

OTHER PUBLICATIONS

Won Jong Nam, et al., "Effects of alloy additions and tempering temperature on the sag resistance of Si-Cr spring steels", Materials Science and Engineering A, vol. A289, No. 1-2, XP-002318428, Sep. 30, 2000, pp. 8-17.

U.S. Appl. No. 11/538,703, filed Oct. 4, 2006, Yoshihara.

U.S. Appl. No. 11/548,080, filed Oct. 10, 2006, Yoshihara, et al.

U.S. Appl. No. 11/559,654, filed Nov. 14, 2006, Yoshihara.

* cited by examiner

STEEL WIRE FOR HARD DRAWN SPRING EXCELLENT IN FATIGUE STRENGTH AND RESISTANCE TO SETTLING, AND HARD DRAWN SPRING AND METHOD OF MAKING THEREOF

TECHNICAL FIELD

The present invention relates to a steel wire for worked springs which is useful as a material subjected to severe cold drawing, and a spring produced using the steel wire. In particular, the present invention relates to a steel wire allowing springs made of hard-drawn wire to exhibit excellent fatigue strength and sag resistance even without subjecting a drawn wire to quenching and tempering treatments, and a spring made of hard-drawn wire capable of exhibiting such properties.

BACKGROUND ART

With a demand for weight reduction and power enhancement in automobiles or the like, valve springs for use in engine, suspension springs or the like have been designed for high-stress use. Further, in relation with increase in load stresses acting on springs, there is also the need for springs having enhanced fatigue strength and sag resistance.

Recently, it has been a custom that most valve springs or suspension springs are produced by subjecting a quenched and tempered steel wire, so-called "oil-tempered wire", to a coiling process at room temperature.

Since the aforementioned oil-tempered wire has a tempered martensite structure, it has advantages of conveniently providing high strength and exhibiting excellent fatigue strength and sag resistance. However, it involves a problematic requirement of a large-scale facility and a high process cost associated with heat treatments, such as quenching and tempering treatments.

Some of springs designed to have a relatively low upper limit on load stresses is produced by drawing carbon steel with a ferrite-pearlite structure or a pearlite structure to obtain a wire having enhanced strength (so called "hard-drawn wire"), and by coiling the hard-dwawn wire at room temperature. According to the JIS, such a spring is defined as "Piano Wire SWP-V", particularly "for valve springs or springs similar thereto", in JIS G 3522 "Piano Wires".

Springs made of the hard-drawn wire as above (hereinafter, referred to as "hard-drawn spring") are advantageously obtained at a low cost because of no need for heat treatments. However, since those conventional hard-drawn wires provide only hard-drawn springs with low fatigue strength and sag resistance, they cannot provide for high-stress springs which are increasingly required in recent years.

There also have been studied various techniques for providing hard-drawn springs for high-stress use in light of the advantage of low-cost production. For example, Japanese Unexamined Patent Publication No. 11-199981 proposes an exemplified method for obtaining cementite of a specific configuration by performing a wire drawing process to pearlite in eutectoid-hypereutectoid steel, which is usable as "a piano wire having properties equivalent to an oil-tempered wire". However, this method inevitably involves increase in production cost due to complicated process, such as changing of drawing direction which is additionally required.

In view of the above, an object of the present invention is to provide a steel wire used for producing hard-drawn springs capable of exhibiting fatigue strength and sag resistance equivalent or superior to springs produced using an oil-tempered wire, and a hard-drawn spring produced using such a steel wire.

DISCLOSURE OF THE INVENTION

An inventive hard-drawn steel wire for spring that has accomplished the above object contains C: 0.5-0.7 mass % (hereinafter, referred to as %), Si: 1.0-1.95%, Mn: 0.5-1.5%, and Cr: 0.5-1.5%, the balance being essentially Fe and inevitable impurities, and contains 5 particles/100 $\mu m^2$ or less of carbides whose circle-equivalent diameters are 0.1 μm or more.

It is effective for the above steel wire further to contain (a) 0.05-0.5% of Ni, and/or (b) 0.3% or less (excluding 0%) of Mo.

The above steel wire can be subjected to a (spring) coiling process to provide a hard-drawn spring capable of exhibiting excellent fatigue strength and sag resistance.

In this hard-drawn spring, given that a residual stress on an inner surface of the spring is ($R_+$), and a residual stress on an outer surface of the spring is ($R_-$), a difference between ($R_+$) and ($R_-$), [($R_+$)−($R_-$)], is preferably set at 500 MPa or less.

The hard-drawn spring of the present invention is preferably produced or designed to meet one or more of the following requirements (1) to (5).

(1) The spring has a surface subjected to a shot peening treatment two times or more.

(2) Given that a residual stress on an inner surface subjected to the shot peening treatment is ($R_{s+}$), and a residual stress on an outer surface subjected to the shot peening treatment is ($R_{s-}$) a difference between ($R_{s-}$) and ($R_{s+}$), [($R_{s+}$)−($R_{s-}$)], is set at 300 MPa or less.

(3) The spring has a surface with a maximum roughness height, Ry, of 10 μm or less.

(4) The spring has a surface subjected to a nitriding treatment.

(5) Given that a coil diameter of the spring is D, and a wire diameter of the spring is d, the ratio of D/d is set at 9.0 or less.

BEST MODE FOR CARRYING OUT THE INVENTION

Figure 1:
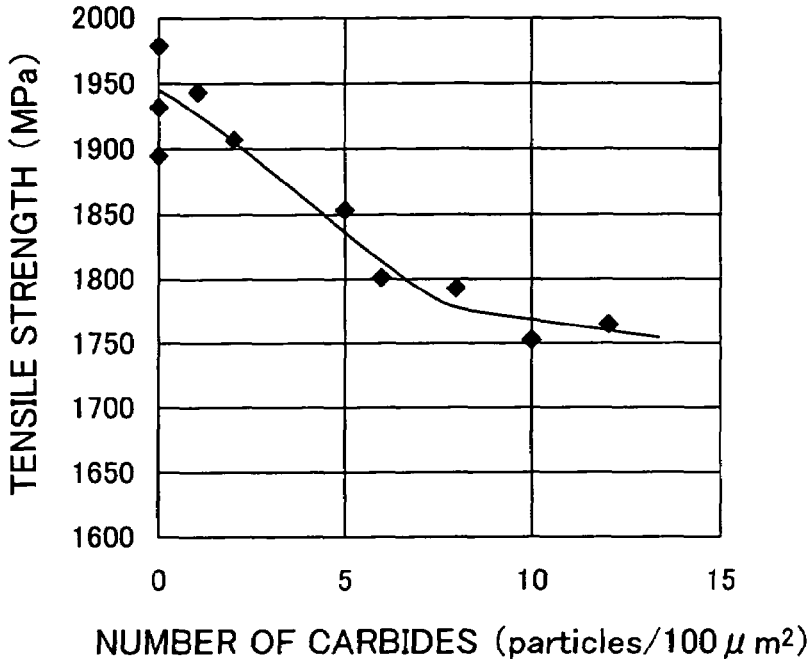
FIG. 1 is a graph showing the relationship between the number of carbides and the tensile strength (after wire drawing).

In order to attain a hard-drawn steel wire capable of achieving the above object, the inventors made extensive study and researches from various angles. Through such study and researches, the inventors had a conception that the fatigue strength and sag resistance of a hard-drawn spring can be improved by strictly defining the chemical composition of a steel wire and adequately controlling the morphology of carbides in the steel wire. That is, it was proved that a relatively large precipitate (carbide) formed after a patenting treatment causes not only difficulties in obtaining an intended drawing but also deterioration in fatigue strength and sag resistance. More specifically, it was found that the fatigue strength and sag resistance can be drastically improved by controlling the number of carbides having circle-equivalent diameters of 0.1

μm or more to be 5 particles or less per 100 $\mu m^2$ in sectional view. Based on the above knowledge, the inventors have accomplished the present invention.

As used in the specification, the term "carbide" means a carbide in particle form, existing as a precipitate, but not includes any cementite phase. The term "circle-equivalent diameter" means a diameter of a hypothetical circle having the same area as that of a carbide.

The steel wire of the present invention is required to adequately regulate its chemical composition. The range of the chemical composition is defined by the following reasons.

C: 0.5 to 0.7%

Carbon, C, is an element useful for providing enhanced tensile strength in a drawn wire and securing a certain fatigue strength and sag resistance in a hard-drawn spring. While the conventional piano wires contains about 0.8% of C, the upper limit of C in a high-strength drawn wire as a target of the present invention is set at 0.7%, because a C content of greater than 0.7% is liable to fracture in performing some works and cause the occurrence of cracks due to surface flaws or inclusions to result in deteriorated fatigue life. However, an excessively reduced C content causes not only difficulties in securing a certain tensile strength required for high-stress springs but also deterioration in fatigue strength and sag resistance. Thus, the C content is required to be set at 0.5% or more. Preferably, the lower limit of C is 0.63%, and the upper limit of C is 0.68%.

Si: 1.0 to 1.95%

Silicon, Si, is an essential element as a deoxidizing agent during steel making. In addition, Si acts as a solid solution in ferrite to provide enhanced temper softening resistance and sag resistance. It is necessary to contain 1.0% or more to obtain these effects. However, an excessive Si content of greater than 1.95% causes deterioration not only in toughness or ductility but also in fatigue resistance due to increase of decarbonization or flaws in a surface part of the wire. Preferably, the lower limit of Si is about 1.2%, and the upper limit of Si is about 1.6%.

Mn: 0.5 to 1.5%

Manganese, Mn, is an element effective for deoxidation during steel making, and an element to make pearlite in fine and orderly arrange, and to contribute to improvement in fatigue properties. It is necessary to contain at least 0.5% of Mn to obtain these effects. However, an excessive Mn content is liable to form a supercooled structure, such as bainite, during a hot-rolling process or a patenting treatment, so as to cause deterioration in drawing performance. Thus, the Mn content is required to be set at 1.5% or lower. Preferably, the lower limit of Mn is about 0.6%, and the upper limit of Mn is about 1.0%.

Cr: 0.5 to 1.5%

Chromium, Cr, is an element useful in narrowing pearlite lamellar spacing, in increasing strength after a rolling process or a heat treatment, and in improving sag resistance. It is necessary to contain at least 0.5% of Cr to obtain these effects. However, an excessive Cr content is liable to form a bainite structure during a patenting treatment and to precipitate a large carbide so as to cause deterioration in fatigue strength and sag resistance. Thus, the Cr content is required to be set at 1.5% or lower. Preferably, the lower limit of Cr is about 0.7%, and the upper limit of Cr is about 1.0%.

The steel wire of the present invention has a fundamental chemical composition as mentioned above, and the balance being essentially Fe. Further, a given amount of Ni or Mo may be effectively contained according to need. Each of these elements is contained in a specific range by the following reasons.

Ni: 0.05 to 0.5%

Nickel, Ni, is an element effective in provide enhanced hardenability and toughness to suppress breakage troubles during a coiling process and provide enhanced fatigue strength. These effects are preferably obtained by adding Ni at 0.05% or more. However, an excessive Ni content leads to form a bainite structure during a hot-rolling process or a patenting treatment so as to cause significant deterioration in drawing performance. Thus, the upper limit of Ni is preferably set at 0.5%.

Mo: 0.3% or less (excluding 0%)

Molybdenum, Mo, is an element effective in securing hardenability and providing enhanced softening resistance to obtain enhanced sag resistance. While these effects are enhanced as a Mo content is increased, an excessive Mo content causes an undesirably extended process time of a patenting treatment and deterioration in ductility. Thus, the upper limit of Mo is preferably set at 0.3%.

The steel wire of the present invention may further contain a slight amount of one or more additional components other than the aforementioned components to the extent that the additional components have no adverse affect on fundamental properties of the steel wire, and it is intended that the steel wire containing such additional components is encompassed within the scope of the present invention. The additional component contained at a slight amount may include impurities, particularly inevitable impurities, such as phosphorus, sulfur, arsenic, antimony or tin.

In the steel wire of the present invention, it is also a critical requirement that the number of carbides having circle-equivalent diameters of 0.1 μm or more is 5 particles or less per 100 $\mu m^2$, as mentioned above. Among some kinds of carbides (such as $Fe_3C$) to be observed after a patenting treatment, carbides having relatively small sizes will effectively provide increased strength based on precipitation hardening. On the other hand, if large size precipitate have been formed, a part of carbons in the matrix will be taken by these carbides, or the amount of the carbons originally contained in the matrix will be reduced. The inventors have found that the amount of the carbons in the matrix has a strong impact on the increase in strength after a patenting treatment or a drawing process, and the decrease of the C amount in the matrix causes difficulties in obtain an intended strength after a patenting treatment or a drawing process which leads to deterioration in fatigue strength and sag resistance.

Then, through the researches on the influences of the carbide morphology onto fatigue strength and sag resistance, the inventors verified that if large carbides whose sizes (circle-equivalent diameters) are 0.1 μm or more exist in a number of greater than 5 particles per 100 $\mu m^2$ in an observational field of view, the fatigue strength and sag resistance will be significantly deteriorated.

In order to control the carbide morphology in the steel wire of the present invention as above, it is effective that setting a heating temperature for a hot-rolling process at 1100° C. or more to facilitate dissolution of the carbides, and that, after completion of the rolling process, cooling the steel wire as quickly as possible at a cooling rate of 5° C./sec or higher in a temperature range of 400 to 600° C. which is a carbide precipitation zone. However, an excessive cooling rate forms bainite to cause deterioration in workability. Thus, the upper limit of the cooling rate is preferably set at 10° C./sec.

Further, during a patenting treatment, the precipitation of carbides can be reduced by controlling a heating temperature for the patenting treatment in the range of 880 to 950° C., preferably about 900 to 940° C. If the heating temperature for the patenting treatment is greater than 950° C., austenite grains will be coarsed to reversely cause deterioration in toughness and ductility, and the coarsed austenite grains will increase the hardenability so as to form a supercooled structure. In order to facilitate dissolution of undissolved carbides, it is recommended to heat the steel wire at a given temperature for a holding time of 50 seconds or longer.

The aforementioned steel wire of the present invention is subjected to a drawing process and a coiling process to obtain a spring (hard-drawn spring) exhibiting desired properties. In the hard-drawn spring of the present invention, it was verified that further enhanced fatigue strength can be achieved by controlling the difference between the respective residual stresses on inner and outer sides of the spring after a spring-forming process (coiling process), hereinafter referred to occasionally as "residual stress difference" for brevity, within 500 MPa.

The above requirement is defined by the following reasons. A residual stress to be given through the spring-forming process (coiling process) is evenly balanced between the inner and outer sides of the spring. Thus, if the residual stress difference after the coiling process has a larger value, the tensile residual stress on the inner side will be increased with the difference. The increased tensile residual stress will accelerate the occurrence and growth of fatigue cracks to cause deterioration in fatigue strength. Moreover, a compressive residual stress to be given through a shot peening will be reduced.

Based on the above knowledge, through studies on the relationship between the residual stress difference in inner and outer sides of the spring, $[(R_+)-(R_-)]$, and fatigue strength, the inventors verified that the fatigue strength can be significantly improved by setting the difference at 500 MPa or less.

Generally, after the spring-forming process, a residual stress in the tensile direction (tensile residual stress) is generated on the inner side of the spring. In contrast, on the outer side of the spring, there are two cases depending on production conditions of the spring: one case where a tensile residual stress is generated, and another case where a residual stress in the compression direction (compressive residual stress) is generated. Thus, it is required to measure the residual stress difference in the present invention while taking account of this point. More specifically, in cased where inner and outer surfaces of the spring have tensile residual stresses, the difference between the stresses may be simply measured. If the residual stress of the outer surface of the spring, $(R_-)$, is a compressive residual stress, the residual stress difference will be derived through a subtraction using the compressive residual stress converted into a minus value. For example, given that a tensile residual stress of an inner surface of the spring is 150 MPa, and a compressive residual stress of an outer surface of the spring is 50 MPa, the residual stress difference, $[(R_+)-(R_-)]$, is derived as follows: $(150)-(-50)=200$ MPa.

As above, in the present invention, the difference between the respective residual stresses on the inner and outer sides of the spring after the coiling process is set at 500 MPa or less to obtain enhanced fatigue strength of the hard-drawn spring. In this approach, the residual stress difference is used as an index for evaluating fatigue strength by the following reasons. A stress (shear stress) on a spring does not act on the inner and outer sides of the spring evenly, but a stress on the inner side of the spring becomes greater than that on the outer side of the spring. For example, when a ratio of a coil diameter of a spring, D, to a wire diameter of the spring, d, (D/d: hereinafter referred to as "spring index") is in the range of 2.0 to 9.0, a Wahl correction factor $A_1$ expressed by the following formula (1) is in the range of 1.16 to 2.06, then the corrected stress is 1.16 to 2.06 times as great as the original stress (see, for example, "Spring", Japan Society for Spring Research, published by Maruzen).

$$A_1=[(4c-1)/(4c-4)]+[0.615/c], \quad (1)$$

where c is a spring index (D/d).

On the other hand, a correction factor for the outer side of the spring, $A_2$,is expressed by the following formula (2). According to this formula, when a spring index is 2.0, the corrected stress acting on the outer side of the spring is 0.514 times of that acting on the inner side of the spring.

$$A_2=[(4c+1)/(4c+4)]+[0.615/c], \quad (2)$$

wherein c is a spring index (D/d).

Thus, a larger shear stress acts on the inner of the spring, and a higher tensile residual stress accelerates deterioration in spring characteristics. Based on only the above viewpoint, a residual stress on an inner side of the spring would be able to be specified. However, it is actually difficult to specify the residual stress, because the surface of the spring still has a tensile residual stress thereon after drawing, and the tensile residual stress is varied depending on drawing conditions and material properties of the steel wire, so that the tensile residual stress is changed by these additive effects even after coiling. Therefore, in the present invention, the difference between the respective residual stresses on the inner and outer sides of the spring is specified and used as the index of fatigue strength.

For example, a stress relief annealing temperature after coiling may be controlled at 400° C. or more as the condition for setting the residual stress difference at 500 MPa or less. If the conventional piano wires are subjected to a stress relief annealing treatment at a temperature of 400° C. or more, the strength of the wire will be decreased to cause deterioration in fatigue strength and sag resistance. In contrast, the steel wire containing a large amount of Si effective in obtaining an excellent result on heat resistance is used as the material of the hard-drawn spring of the present invention. Thus, even if the spring is subjected to the stress relief annealing treatment at a temperature of 400° C. or more, strain caused by a coiling process can be removed without substantial deterioration in strength.

The effects in the hard-drawn spring of the present invention can be effectively brought out by subjecting the surface of the spring to a shot peening treatment two times or more. Typically, valve springs and similar high-stress springs are used after a compressive residual stress is given to the surface layer of the spring through a shot peening treatment. The shot peening treatment is an effective means by shooting hard balls (shot particles) with high-grade hardness onto a surface of a workpiece at a high speed to give a compressive residual stress to the surface for suppressing the occurrence of surface cracks to provide enhanced fatigue strength.

In addition, the above shot peening treatment is effective in giving a compressive residual stress in the surface of a spring to suppress the growth of fatigue cracks. Springs to be subjected to the shot peening treatment require a high compressive residual stress because they are used, particularly, under high-stress conditions. Thus, the residual stress difference as above has to be further strictly managed. In view of this need, it is preferable to set the above residual stress difference at 300 MPa or less.

A large surface roughness of the spring is liable to cause an occurrence of a fatigue failure. In view of providing enhanced fatigue strength, it is preferable to set the surface roughness, Ry, (maximum height, see JIS B 0601) of the spring at 10 μm or less. For example, when the subjected to a high-intensity shot peening treatment two times or more as mentioned above, the surface has a larger surface roughness due to deformation thereof in some cases. Particularly, in some materials, such as hard-dawned wires, the weakest part of ferrite is largely deformed to cause deterioration in surface roughness. While means for adjusting the surface roughness in the above manner is not limited to a specific technique, the conditions of the shot peening treatment may be appropriately controlled to achieve such a surface roughness.

In consideration with the control of the above surface toughness Ry, desirable conditions of the shot peening may be set as follows. A first-stage shot peening treatment is performed using shot particles having a particle size of 1.0 to 0.3 mm, at a particle speed of 30 to 100 m/sec, for a shooting time of 20 to 200 minutes. Preferable, the hardness of shot particles is a Vickers hardness (Hv) of 500 or more.

Then, a second-stage shot preening treatment is performed using shot particles having a smaller particle size than that in the first-stage. Preferably, this particle size is 1/10 or less of that in the first-stage. A shooting time in the second stage is set at about 10 to 200 minutes. Through the second-stage shot peening treatment, the surface roughness can be decreased, and the compressive residual stress of the surface can be increased to provide further enhanced fatigue strength. The inventors verified that as compared to the oil-tempered wire subjected to quenching and tempering treatments, the effect of the second-stage shot peening treatment is more effectively exhibited in the hard-drawn spring.

If it is assumed that the hard-drawn spring of the present invention will be used under particularly severe stress conditions, the surface of the spring may be effectively subjected to a nitriding treatment. The nitriding treatment can further improve the fatigue strength. While such a nitriding treatment has heretofore been applied to valve springs produced using the oil-tempered wire, it has not been implemented in the hard-drawn spring at all. That is, it has been believed that, in view of the chemical composition of the conventional hard-drawn wire, any significant effect cannot be expected even if the conventional hard-drawn wire is subjected to a nitriding treatment, and that strain introduced during a drawing process is undesirably released through the nitriding treatment to cause significant deterioration in strength of the spring.

By contrast, when a steel wire having a chemical composition defined in the present invention is subjected to the nitriding treatment after a drawing process, the fatigue strength of the spring can be further improved. The reason for such effectiveness can be explained as follows. The strength of the steel wire for use in the present invention depends on the strength of ferrite itself, which is strengthened by some alloy elements, such as Si or Cr. Thus, the increase in strength of the ferrite through the nitriding treatment can lead directly to improvement in fatigue strength. While the surface of the spring produced through a nitriding treatment preferably has a Vickers hardness (Hv) of 600 or larger, more preferably 700 or larger, at a depth of 0.02 mm, it may has a HV of about 500 to 600 depending on a required fatigue strength.

The nitriding treatment is not limited to a specific process, but any suitable processes, such as a gas nitriding process, a liquid (salt-bath) nitriding process or an ion nitriding process, may be used. For example, the gas nitriding treatment is preferably performed under an atmosphere of 100% ammonia gas, or an atmosphere containing ammonia gas as a primary gas, 50% or less of nitrogen gas and 10% or less of carbon dioxide gas, at 350 to 470° C., for 1 to 6 hours.

The effects of the present invention are further effectively exhibited when applied to a small coil diameter spring having a spring index (D/d) of 9.0 or less. In a spring, the (D/d) indicates the index of the spring. The spring having the ratio (D/d) falling within the above range indicates a large difference between the respective stresses on the inner and outer sides of the spring in obtaining a desired load response, and a high stress acts on the inner side of the spring. Even under such a high-stress use condition, the spring of the present invention can adequately keep its functions. The ratio (D/d) is smaller, this effect is exhibited more clearly. However, less than 2.0 of the ratio (D/d) causes difficulties in obtaining the effect of the surface treatment, such as a shot peening treatment. Thus, the lower limit of the ratio (D/d) is preferably set at 2.0.

EXAMPLES

The present invention will be described in more detail below in connection with various examples. The present invention is not limited by the following examples, but it is intended that all modifications to be made according to the context are encompassed within the scope of the present invention.

Example 1

Steels (A to K) having chemical compositions as shown in the following Table 1 were melt, poured into a mold, and hot-rolled to prepare wire rods having a diameter (wire diameter) of 8.0 mm. The hot rolling was performed under the following conditions. Heating temperature: 1150° C., cooling rate after rolling: 6.3° C./sec. Then, shaving, patenting, and wire drawing were performed to form steel wires having a wire diameter of 3.1 mm. Patenting was performed by at an austenitizing temperature as shown in Table 2, and then isothermally transformed in a lead bath at 550 to 650° C. depending on each kind of steels. An austenitizing time for the patenting treatment was set at 130 sec for No. 2, at 100 sec for No. 3 and at 240 sec for the remaining steels in Table 2, to regulate the amount of carbides.

TABLE 1

| Kind of | Chemical Composition (mass %) | | | | | |
|---|---|---|---|---|---|---|
| Steel | C | Si | Mn | Cr | Ni | Mo |
| A | 0.65 | 1.45 | 0.82 | 0.85 | — | — |
| B | 0.53 | 1.53 | 0.75 | 1.00 | — | — |
| C | 0.65 | 1.91 | 0.90 | 0.64 | — | — |
| D | 0.61 | 1.36 | 0.59 | 1.45 | — | — |
| E | 0.82 | 0.25 | 0.71 | — | — | — |
| F | 0.92 | 0.25 | 0.75 | — | — | — |
| G | 0.80 | 1.90 | 0.85 | 0.85 | — | — |
| H | 0.45 | 1.41 | 0.72 | 0.69 | — | — |
| I | 0.62 | 1.35 | 0.79 | 1.68 | — | — |
| J | 0.60 | 1.51 | 0.83 | 0.92 | 0.21 | — |
| K | 0.55 | 1.47 | 0.78 | 0.82 | 0.23 | 0.18 |

Steel E is equivalent to JIS-SWP-V.

For each of the obtained steel wires (drawn wires), the size and the number of carbides were measured. This measurement was performed by sampling the cross-section of the steel wires, taking a picture at a position of D/4 (D: diameter) using a scanning electron microscope (SEM) in a magnification of 5000 times, and counting the number of carbides who have a circle-equivalent diameter of 0.1 μm or more in 100

$\mu m^2$ of the obtained photographs. Further, tensile strengths, TS, after the drawing were measured.

The drawn wires were formed into springs at room temperature, and subjected to stress relief annealing (400° C.×20 minutes), seat position grinding, dual stage shot peening, low temperature annealing (230° C.×20 minutes), and presetting. Also, tensile strength, TS, after tempering, which is equivalent to the stress relief annealing treatment, was measured. A part (No. 3 in Table 2) of the steels was subjected to a nitriding treatment under the following conditions: 80% of $NH_3$+20% of $N_2$; 400° C.×2 hours.

Each of the obtained springs was subjected to a fatigue test under a load stress of 588±441 MPa to measure a fracture life. Further, each of the spring was clamped at 120° C. under a stress of 1000 MPa for 48 hours, and then residual shear strain in the spring was measured and used as an index of sag resistance (a smaller residual shear strain means a better sag resistance).

Figure 2:
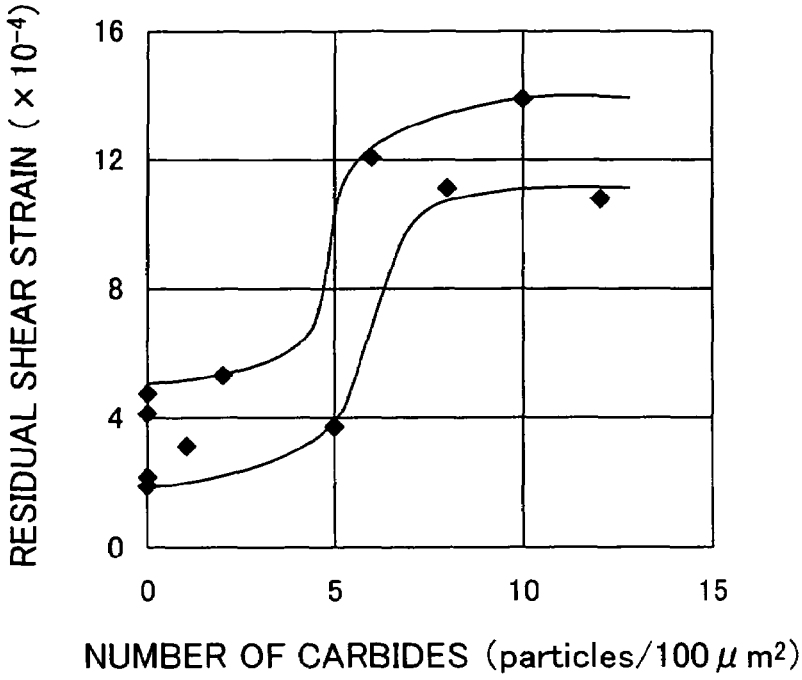
FIG. 2 is a graph showing the relationship between the number of carbides and the residual shear strain.
Figure 3:
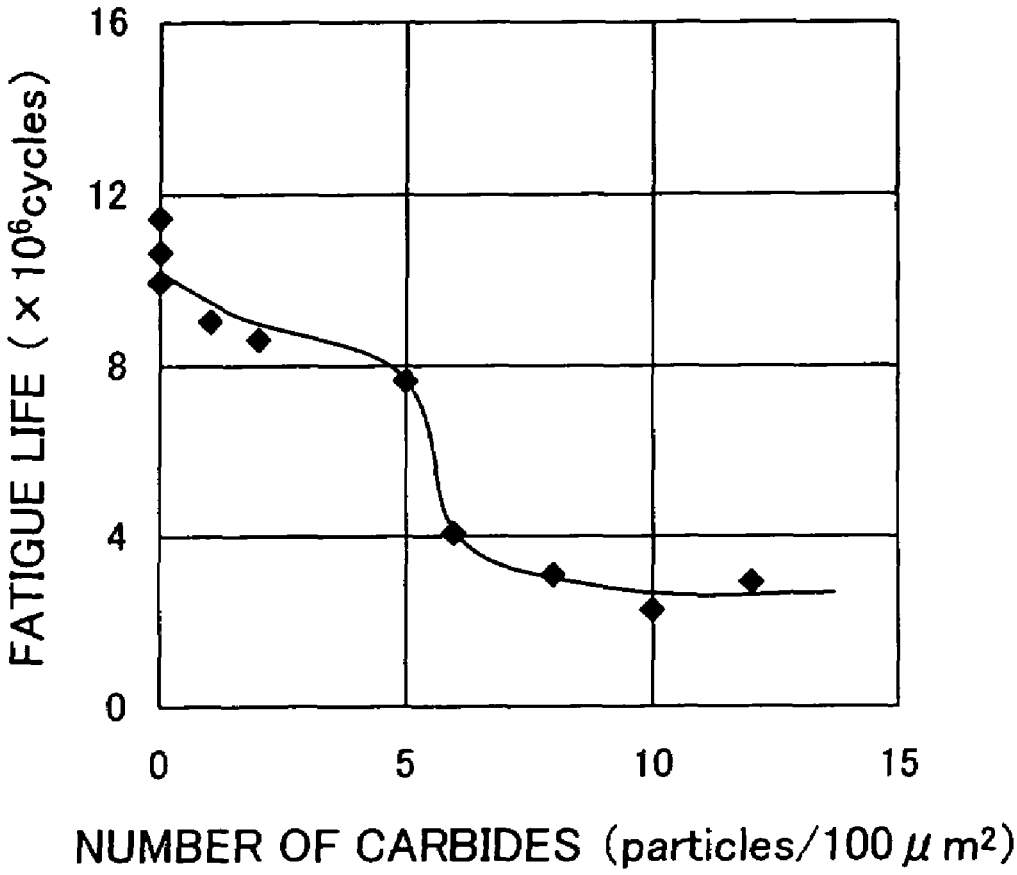
FIG. 3 is a graph showing the relationship between the number of carbides and the fatigue life.

These results are shown in Table 2 together with the production condition (heating temperature for the patenting treatment), the tensile strength, TS, of the steel wires (after the drawing, and after the stress relief annealing treatment), the number of carbides, the surface roughness, Ry, and with nitriding treatment or not. Further, based on these results, the relationship between the number of carbides and the tensile strength (after the drawing) is shown in FIG. 1. The relationship between the number of carbides and the residual shear strain is shown in FIG. 2, and the relationship between the number of carbides and the fatigue life is shown in FIG. 3 respectively.

increased amount of carbide precipitation causes difficulties in securing a sufficient strength after the drawing, resulting in a short fatigue life and a large residual shear strain.

While No. 9 is equivalent to JIS-SWP-V (piano wire), it contains a larger amount of C. The large content of C causes breakage triggered by inclusions in an early stage, resulting in a short fatigue life. Further, a smaller amount of Si leads to poor temper softening resistance, and no content of Cr causes a large residual shear strain.

Similarly, No. 10 containing a larger amount of C than that of No. 9 has breakage by inclusions in an early stage, resulting in a shorter fatigue life. Further, a smaller amount of Si leads to poor temper softening resistance, and no content of Cr causes a large residual shear strain.

No. 11 containing a larger amount of C also has breakage by inclusions in an early stage, resulting in a shorter fatigue life.

No. 12 containing a small amount of C has a deteriorated strength after the patenting treatment, and an insufficient strength after the drawings, resulting in a short fatigue life and a large residual shear strain.

In No. 13 containing a large amount of Cr, carbides act as a solid solution in the matrix during the patenting treatment, resulting in a short fatigue life and a significantly deteriorated sag resistance.

Example 2

Steels (L to U) having chemical compositions as shown in the following Table 3 were melt, poured into a mold, and

TABLE 2

| No. | Kind of Steel | Austenitizing Temperature for Patenting (° C.) | Tensile Strength TS (MPa) After Drawing | Tensile Strength TS (MPa) After Stress relief annealing | Number of Carbides (particles/100 $\mu m^2$) | Surface Roughness Ry (μm) | Nitriding | Residual Shear Strain ($\times 10^{-4}$) | Fatigue Life ($\times 10^6$ cycles) |
|---|---|---|---|---|---|---|---|---|---|
| 1 | A | 930 | 1915 | 1911 | 0 | 9.8 | NOT | 4.2 | 10.1 |
| 2 | A | 900 | 1881 | 1901 | 2 | 6.7 | NOT | 5.3 | 8.7 |
| 3 | A | 890 | 1853 | 1898 | 5 | 8.4 | WITH | 3.7 | 15.8 |
| 4 | A | 940 | 1944 | 1941 | 0 | 12.4 | NOT | 4.8 | 5.3 |
| 5 | B | 920 | 1938 | 1870 | 1 | 5.5 | NOT | 3.1 | 9.1 |
| 6 | C | 930 | 1955 | 2054 | 0 | 7.9 | NOT | 1.9 | 11.5 |
| 7 | D | 950 | 1910 | 1874 | 0 | 9.2 | NOT | 2.2 | 10.7 |
| 8 | A | 870 | 1843 | 1732 | 8 | 8.6 | NOT | 11.1 | 3.1 |
| 9 | E | 910 | 1770 | 1668 | 0 | 5.8 | NOT | 10.1 | 2.5 |
| 10 | F | 950 | 1953 | 1742 | 0 | 8.3 | NOT | 12.8 | 0.9 |
| 11 | G | 940 | 1831 | 1845 | 0 | 7.3 | NOT | 9.5 | 4.6 |
| 12 | H | 880 | 1743 | 1652 | 0 | 9.8 | NOT | 12.5 | 1.0 |
| 13 | I | 920 | 1733 | 1796 | 12 | 8.3 | NOT | 10.8 | 2.9 |
| 14 | J | 900 | 1921 | 1953 | 0 | 7.2 | NOT | 3.5 | 10.4 |
| 15 | K | 930 | 1967 | 1999 | 0 | 8.3 | NOT | 2.7 | 12.6 |

In view of these results, the following points can be found out. Firstly, each of Nos. 1 to 7, 14 and 15 meets the requirements of the present invention, and exhibits excellent fatigue strength and sag resistance. In particular, it is verified that excellent properties are exhibited by setting the number of carbides with a given size at 5 particles/100 μm or less.

In contrast, each of Nos. 8 to 12 lacks at least any one of the requirements of the present invention, and thereby has some poor properties. Specifically, while No. 8 has the same chemical composition as that of Nos. 1 to 4, it has a lower heating temperature for the patenting treatment. The resulting hot-rolled to prepare wire rods having a diameter (wire diameter) of 8.0 mm. Then, shaving, patenting, and wire drawing Were performed to form steel wires having a wire diameter of 3.1 mm. Patenting was performed at the austenitizing temperature of 910° C., and then the wires were isothermally transformed in a lead bath at 550 to 650° C. depending on each kind of steels. An austenitizing time for the patenting treatment was set at 300 sec for Nos. 20 and 31, at 30 sec for No. 30 and at 120 sec for the remaining steels in Tables 5 and 6, to regulate the amount of carbides.

TABLE 3

| Kind of Steel | Chemical Composition (mass %) C | Si | Mn | Cr | Ni | Mo |
|---|---|---|---|---|---|---|
| L | 0.65 | 1.51 | 0.77 | 0.82 | — | — |
| M | 0.58 | 1.45 | 0.79 | 0.75 | — | — |
| N | 0.51 | 1.49 | 0.75 | 1.15 | — | — |
| O | 0.66 | 1.97 | 0.93 | 0.62 | — | — |
| P | 0.61 | 1.33 | 0.55 | 1.45 | — | — |
| Q | 0.92 | 0.25 | 0.75 | — | — | — |
| R | 0.45 | 1.41 | 0.72 | 0.69 | — | — |
| S | 0.62 | 1.35 | 0.79 | 1.68 | — | — |
| T | 0.64 | 1.47 | 0.81 | 0.97 | 0.31 | — |
| U | 0.61 | 1.53 | 0.70 | 0.85 | 0.18 | 0.21 |

Among the obtained steel wires (drawn wires), the steel wired of Steels L, M and N were formed into springs (spring index: 6.81), and subjected to stress relief annealing (350, 380, 410° C.×20 minutes), seat position grinding, and presetting.

Each of the obtained springs was subjected to a fatigue test under a load stress of 588±441 MPa to measure a fracture life. Further, each of a residual stress on the inner side of the spring, ($R_+$), and a residual stress on the outer side of the spring, ($R_-$), was measured according to an X-ray diffraction method to determine a residual stress difference, [($R_+$)−($R_-$)]. Furthermore, each of the tensile strength of the steel wire (after the drawing, and after the stress relief annealing treatment) was measured, and each of the surface roughness, Ry, was measured. These results are shown in Table 4 together with the stress relief annealing temperature.

TABLE 4

| No. | Kind of Steel | D/d | Tensile Strength (MPa) After Drawing | After Stress relief annealing | Temperature for Stress relief annealing (° C.) | ($R_+$) − ($R_-$) (MPa) | Surface Roughness Ry (μm) | Fatigue Life (×10$^6$ cycles) |
|---|---|---|---|---|---|---|---|---|
| 16 | L | 6.81 | 1942 | 1960 | 350 | 954 | 2.7 | 1.8 |
| 17 | L | 6.81 | 1942 | 1963 | 380 | 764 | 3.6 | 2.7 |
| 18 | L | 6.81 | 1942 | 1949 | 410 | 253 | 3.1 | 8.7 |
| 19 | M | 6.81 | 1856 | 1881 | 410 | 108 | 2.4 | 10.0 |
| 20 | N | 6.81 | 1832 | 1854 | 410 | 333 | 2.2 | 7.9 |

As seen in these results, the springs having the residual stress difference of 500 MPa or less (Nos. 18 to 20) achieve excellent fatigue strengths. In contrast, the springs having the residual stress difference of greater than 500 MPa (Nos. 16 and 17) have significantly deteriorated fatigue strengths.

Example 3

Based on Steels (L to U) obtained in the same manner as that in Example 2, springs having various spring indexes were formed, and subjected to stress relief annealing (350, 380, 410° C.×20 minutes), seat position grinding, dual-stage shot peening, low temperature annealing (230° C.×20 minutes), and presetting. In these treatments, after the seat position grinding, the Steel N was subjected to a nitriding treatment under the following conditions: 80% of $NH_3$+20% of $N_2$; 420° C.×2 hours, and then subjected to the dual-stage shot peening, the low temperature annealing (230° C.×20 minutes), and the presetting to prepare No. 26 in Table 5 as described later.

Each of the obtained springs was subjected to a fatigue test in the same manner as that in Example 1 to measure a fracture life and a residual shear strain. Further, a residual stress on the inner side of the spring after the spring-forming process (before the shot peening treatment), ($R_+$), a residual stress on the outer side of the spring after the spring-forming process (before the shot peening treatment), ($R_+$), a residual stress on the inner side of the spring after the shot peening treatment, ($R_{s+}$), and a residual stress on the outer side of the spring after the shot peening treatment, ($R_{s-}$) were measured according to an X-ray diffraction method to determine respective residual stress differences, [($R_+$)−($R_-$)] and [($R_{s+}$)−($R_{s-}$)]. Furthermore, as with Example 2, the number of carbides and the tensile strength (after the drawing and after stress relief annealing treatment) of the drawn wires were measured, and also the surface roughness, Ry, was measured. These results are shown in Tables 5 and 6 together with the spring index and the stress relief annealing temperature.

TABLE 5

| No. | Kind of Steel | D/d | Tensile Strength TS (MPa) After Drawing | After Stress relief annealing | Number of Carbides (particles/100 μm$^2$) |
|---|---|---|---|---|---|
| 21 | L | 6.81 | 1942 | 1960 | 1 |
| 22 | L | 6.81 | 1942 | 1963 | 2 |

TABLE 5-continued

| No. | Kind of Steel | D/d | Tensile Strength TS (MPa) After Drawing | After Stress relief annealing | Number of Carbides (particles/100 μm$^2$) |
|---|---|---|---|---|---|
| 23 | L | 6.81 | 1942 | 1949 | 2 |
| 24 | M | 3.65 | 1856 | 1881 | 5 |
| 25 | N | 2.87 | 1832 | 1854 | 4 |
| 26 | N | 2.55 | 1832 | 1854 | 0 |
| 27 | O | 8.55 | 1905 | 1970 | 2 |
| 28 | P | 7.02 | 1911 | 1945 | 0 |
| 29 | Q | 6.81 | 1930 | 1769 | 5 |
| 30 | R | 6.81 | 1705 | 1638 | 0 |
| 31 | S | 6.81 | Breakage occurred during drawing. | | |
| 32 | T | 6.81 | 1937 | 1949 | 5 |
| 33 | U | 6.81 | 1985 | 2016 | 4 |

TABLE 6

| No. | Kind of Steel | Temperature for Stress relief annealing (° C.) | $(R_+) - (R_-)$ (MPa) | $(R_{5+}) - (R_{5-})$ (MPa) | Surface Roughness Ry (μm) | Nitriding | Residual Shear Strain ($\times 10^{-4}$) | Fatigue Life ($\times 10^6$ cycles) |
|---|---|---|---|---|---|---|---|---|
| 21 | L | 350 | 954 | 531 | 7.3 | NOT | 4.1 | 0.8 |
| 22 | L | 380 | 764 | 429 | 8.1 | NOT | 3.7 | 3.9 |
| 23 | L | 410 | 253 | 131 | 7.9 | NOT | 4.5 | 8.7 |
| 24 | M | 410 | 108 | 67 | 6.7 | NOT | 4.0 | 12.5 |
| 25 | N | 410 | 333 | 265 | 5.4 | NOT | 3.7 | 9.8 |
| 26 | N | 410 | 401 | 176 | 6.2 | WITH | 2.9 | 16.3 |
| 27 | O | 410 | 96 | 45 | 11.8 | NOT | 3.9 | 7.0 |
| 28 | P | 410 | 179 | 103 | 5.5 | NOT | 3.9 | 10.8 |
| 29 | Q | 410 | 233 | 119 | 7.6 | NOT | 12.0 | 2.1 |
| 30 | R | 410 | 319 | 164 | 9.5 | NOT | 12.1 | 0.9 |
| 31 | S | | | Breakage occurred during drawing. | | | | |
| 32 | T | 410 | 427 | 214 | 6.9 | NOT | 4.1 | 11.7 |
| 33 | U | 410 | 214 | 93 | 10.8 | NOT | 4.3 | 13.5 |

In view of these results, the following points can be found out. Firstly, each of Nos. 23 to 28, 32 and 33 meets the requirements of the present invention, and exhibits excellent fatigue strength and sag resistance.

In contrast, each of Nos. 21, 22, 29 and 31 lacks at least any one of the requirements of the present invention, and thereby has some poor properties. Specifically, Nos. 21 and 22 have significantly deteriorated fatigue strength due to large differences between the respective residual stresses on the inner and outer sides of the spring (after the drawing and after the shot peening).

No. 29 containing a large amount of C has high defect sensitivity. Further, a low content of Si causes difficulties in obtaining a sufficient strength after the stress relief annealing treatment, resulting in a short fatigue life and a poor sag resistance.

No. 31 containing a low amount of C has deteriorated strength after the patenting treatment, and cannot obtain a sufficient strength, resulting in a short fatigue life and a poor sag resistance.

In No. 32 containing a large amount of Cr, bainite formed during the patenting treatment causes breakage during the drawing.

INDUSTRIAL APPLICABILITY

The present invention constructed as above can provide a steel wire for allowing a hard-drawn spring to be produced therefrom with fatigue strength and sag resistance equal or superior to springs produced using an oil-tempered wire, and a hard-drawn spring produced using such a steel wire.

What is claimed is:

1. A hard-drawn steel wire comprising:

C: 0.5-0.68 mass % (hereinafter, referred to as %),

Si: 1.2-1.95%,

Mn: 0.5-1.5%,

Cr: 0.62-1.5%,

Fe and inevitable impurities, wherein said wire consists of at least one selected from the group consisting of ferrite and pearlite, and said wire further comprises 5 particles/100 $\mu m^2$ or less of carbides wherein the circle-equivalent diameters of the carbides are more than 0.1 μm.

2. The steel wire according to claim 1, further comprising 0.05-0.5% of Ni.

3. The steel wire according to claim 1, further comprising 0.3% or less (excluding 0%) of Mo.

4. The steel wire according to claim 2, further comprising 0.3% or less (excluding 0%) of Mo.

5. The steel wire according to claim 1, said wire comprising 2 particles/100 $\mu m^2$ or less of carbides wherein the circle-equivalent diameters of the carbides are more than 0.1 μm.

6. The steel wire according to claim 5, further comprising 0.05-0.5% of Ni.

7. The steel wire according to claim 5, further comprising 0.3% or less (excluding 0%) of Mo.

8. The steel wire according to claim 6, further comprising 0.3% or less (excluding 0%) of Mo.

9. A method of using a steel wire, the method comprising coiling the steel wire of claim 1 into a spring.

10. The steel wire according to claim 1, wherein the carbides are controlled by subjecting a steel rod to a hot rolling treatment comprising heating at 1100° C. or more followed by hot rolling, and after completion of hot rolling cooling to a temperature range of 400 to 600° C. at a cooling rate of 5 to 10° C./sec.

11. The steel wire according to claim 10, wherein the carbides are further controlled by subjecting the steel rod, after the hot-rolling treatment, to a patenting treatment comprising austenitizing at a temperature of 880 to 950° C. for a holding time of 50 seconds or longer and isothermally transforming at a temperature of 550 to 650° C.

12. A method of making a steel wire, the method comprising subjecting a steel rod comprising 0.5-0.68% of C, 1.2-1.95% of Si, 0.5-1.5% of Mn, 0.62-1.5% of Cr, Fe and inevitable impurities to a hot-rolling treatment comprising heating at 1100° C. or more followed by hot rolling, and after completion of hot rolling cooling to a temperature range of 400 to 600° C. at a cooling rate of 5 to 10° C./sec to produce the steel wire of claim 1.

13. The steel wire according to claim 1, wherein said wire consists of ferrite.

14. The steel wire according to claim 1, wherein said wire consists of pearlite.

15. The steel wire according to claim 1, wherein the wire comprises 0.63-0.68% of C.

16. The steel wire according to claim 1, wherein the wire comprises 1.2-1.6% of Si.

17. The steel wire according to claim 1, wherein the wire comprises 0.6-1.0% of Mn.

18. The steel wire according to claim 1, wherein the wire comprises 0.7-1.0% of Cr.

* * * * *